US006393634B1

(12) United States Patent
Kodaira et al.

(10) Patent No.: US 6,393,634 B1
(45) Date of Patent: May 28, 2002

(54) AUTOMATIC FAUCET

(75) Inventors: Makoto Kodaira, Setagaya-ku; Mitsuya Kaneko, Funabashi, both of (JP)

(73) Assignee: Uro Denshi Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/442,484

(22) Filed: Nov. 18, 1999

(30) Foreign Application Priority Data

Sep. 16, 1999 (JP) ..... 11-262570

(51) Int. Cl.[7] ..... E03C 1/05
(52) U.S. Cl. ..... 4/623; 4/668; 4/675
(58) Field of Search ..... 4/623, 668, 675–678

(56) References Cited

U.S. PATENT DOCUMENTS 4,682,628 A * 7/1987 Hill ..... 4/623
5,063,622 A * 11/1991 Tsutsui et al. ..... 4/623
5,566,702 A * 10/1996 Philipp
5,570,869 A * 11/1996 Diaz et al. ..... 4/623
5,758,688 A * 6/1998 Hamanaka et al. ..... 4/623
5,769,120 A * 6/1998 Laverty, Jr. et al. ..... 4/623
5,984,262 A * 11/1999 Parsons et al. ..... 4/623

FOREIGN PATENT DOCUMENTS

EP 463440 * 1/1992 ..... 4/623
JP 4-261927 * 9/1992 ..... 4/623

* cited by examiner

*Primary Examiner*—Charles R. Eloshway
(74) *Attorney, Agent, or Firm*—Jacobson Holman, PLLC

(57) ABSTRACT

An automatic faucet, wherein the reference value can be reset in accordance with the state of a sink, without requiring further adjustment. The automatic faucet includes a faucet; a sink which receives water emitted from the faucet; a light generator for radiating infrared rays toward the bottom of the sink; a light receiver for receiving infrared rays, reflected from the bottom of the sink, and detecting an amount of light thereby received; a flush output portion for comparing the detection output from the light receiver with a reference value, and creating a flush output when the detection output exceeds a predetermined value; and a faucet controller for opening and closing the faucet in accordance with the output of the flush output portion.

6 Claims, 8 Drawing Sheets

AUTOMATIC FAUCET

BACKGROUND OF THE INVENTION

1. Field of the Invention

The present invention relates to an automatic faucet, incorporated in a sink or a urinal or such like, which flushes when a person is detected, and more particularly to an automatic faucet in which flushing is controlled by detecting infrared rays.

2. Description of the Related Art

In a washroom sink or an automatic toilet, infrared rays are radiated toward a person, the presence of the person is detected based on how the infrared rays are reflected, and, when the person has been detected, flushing is carried out by controlling a flush valve. In the case of a sink, a sensor is provided near the flush hole and infrared rays are radiated downward like the flow of water to the bottom wall of the sink, so that hands inserted near the tap can be easily detected.

When this radiated light is reflected midway by the hands of a user, the amount of radiated light increases. Using this effect, the presence of the user is detected by comparing the amount of reflection with a reference value, and flushing is carried out accordingly. When the user retracts his hands and the amount of reflection returns to its original amount, this is detected and the flushing stops.

FIG. 7 shows the construction of a conventional automatic faucet which performs this operation. A microcomputer 1 uses the output from a drive circuit 2 to radiate infrared rays from an infrared light transmitter 3 toward the body of a user 4. The reflected light is detected by a light receiver 5, amplified by an amplifier 6, and the microcomputer 1 reads the result of a comparison performed by a comparator 7. Then, a driver 8 opens and closes an electromagnetic valve 9 in compliance with a two-value determination output from the microcomputer 1.

The distance from the sensor to the bottom of the sink varies depending on the dimensions of the sink, and therefore the reference value, which the reflection amount is compared with, needs to be altered. This is achieved by adjusting a variable resistor, connected to the reference input terminal of the comparator 7. The reference value is set higher than the value of the amount of reflected light so that, if the amount of light reflected from the sink gradually increases due to environmental changes, flushing does not happen of its own accord.

The reference value is set based on intuition gained from experience, and is consequently difficult to set appropriately. Moreover, as shown at the symbol VR in FIG. 8, the variable resistor is provided at a position of poor workability which is awkward for a person to reach, such as on the lower side of the washbasin.

Furthermore, when a cup or the like has been placed on the bottom wall of the sink, it may be mistakenly detected as a hand, causing continuous flushing.

To prevent such inconveniences, some automatic faucets have a function whereby, when infrared rays have been detected for longer than a predetermined time, flushing is temporarily stopped, and does not continue until reflection is detected a second time after a predetermined amount of reflected light has disappeared.

However, this function is complex since flushing is not repeated until the cup or the like is removed, requiring that the cup or the like be extracted.

Furthermore, when installing an automatic faucet to an existing washbasin, the washbasin may already be dirty and have poor reflectivity. When the detection distance is set for a washbasin in such a state, the reflectivity of infrared rays will improve if the washbasin is subsequently cleaned. Consequently, the automatic faucet mistakenly detects hands even though no hands are present, and flushes as a result.

On the other hand, there is a problem that, when the reference value of a sink with excellent reflectivity has been set, its range of detection is narrow.

In the case of a urinal, the worker who performs the adjustment must avoid working within positions at which a user will be detected, resulting in poor workability.

In any case, since the operation must be performed manually, there are inevitably inaccurate adjustments, and adjustment takes considerable time to complete.

SUMMARY OF THE INVENTION

The present invention has been devised in consideration of the points mentioned above, and aims to provide an automatic faucet, wherein a reference value can be automatically set in accordance with the state of the sink, without requiring further adjustment.

In order to achieve the above objects, the automatic faucet of the present invention comprises a faucet; a sink which receives water from the faucet; a light generator for radiating infrared rays toward the bottom wall of the sink; a light receiver for receiving infrared rays, reflected from the bottom of the sink, and detecting an amount of light thereby received; a flush output portion for comparing the detection output from the light receiver with a reference value, and creating a flush output when the detection output exceeds a predetermined value; and a faucet controller for opening and closing the faucet in correspondence with an output of the flush output portion; the automatic faucet further comprising: command means for generating a command signal to correct the reference value; a detection means for detecting the maximum amount of light, received by the light receiver when a signal has been supplied by the command means; and a reference value correction means for correcting the reference value in the flush output portion, based on the maximum amount of light.

DESCRIPTION OF THE PREFERRED EMBODIMENTS

Figure 1:
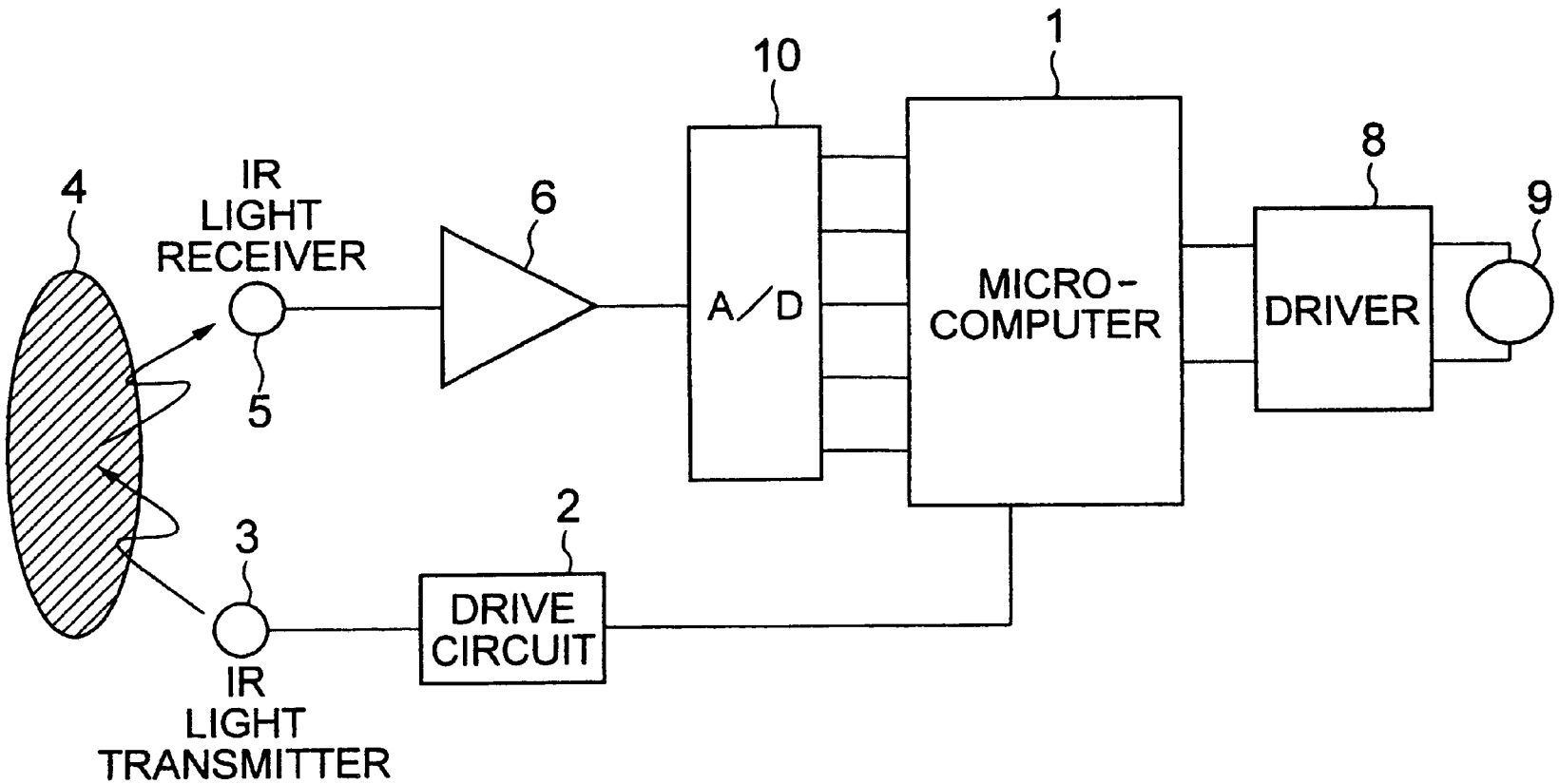
FIG. 1 is a block line diagram of the circuit constitution of the first embodiment of the present invention.

FIG. 1 is a block line diagram showing the circuit constitution of the first embodiment of the present invention.

Figure 7:
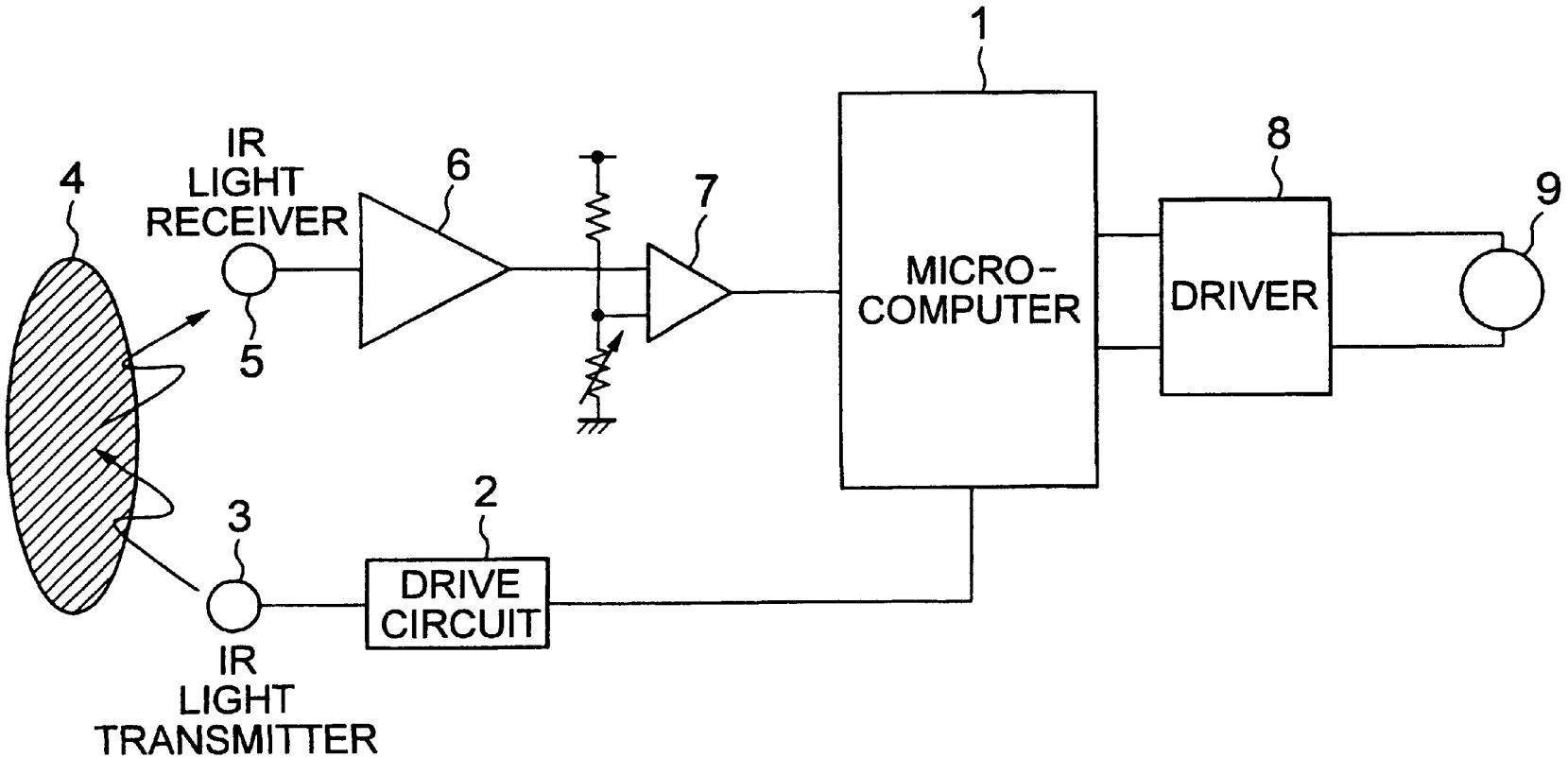
FIG. 7 (PRIOR ART)
FIG. 7 is a block line diagram of a conventional flush control circuit.
Figure 8:
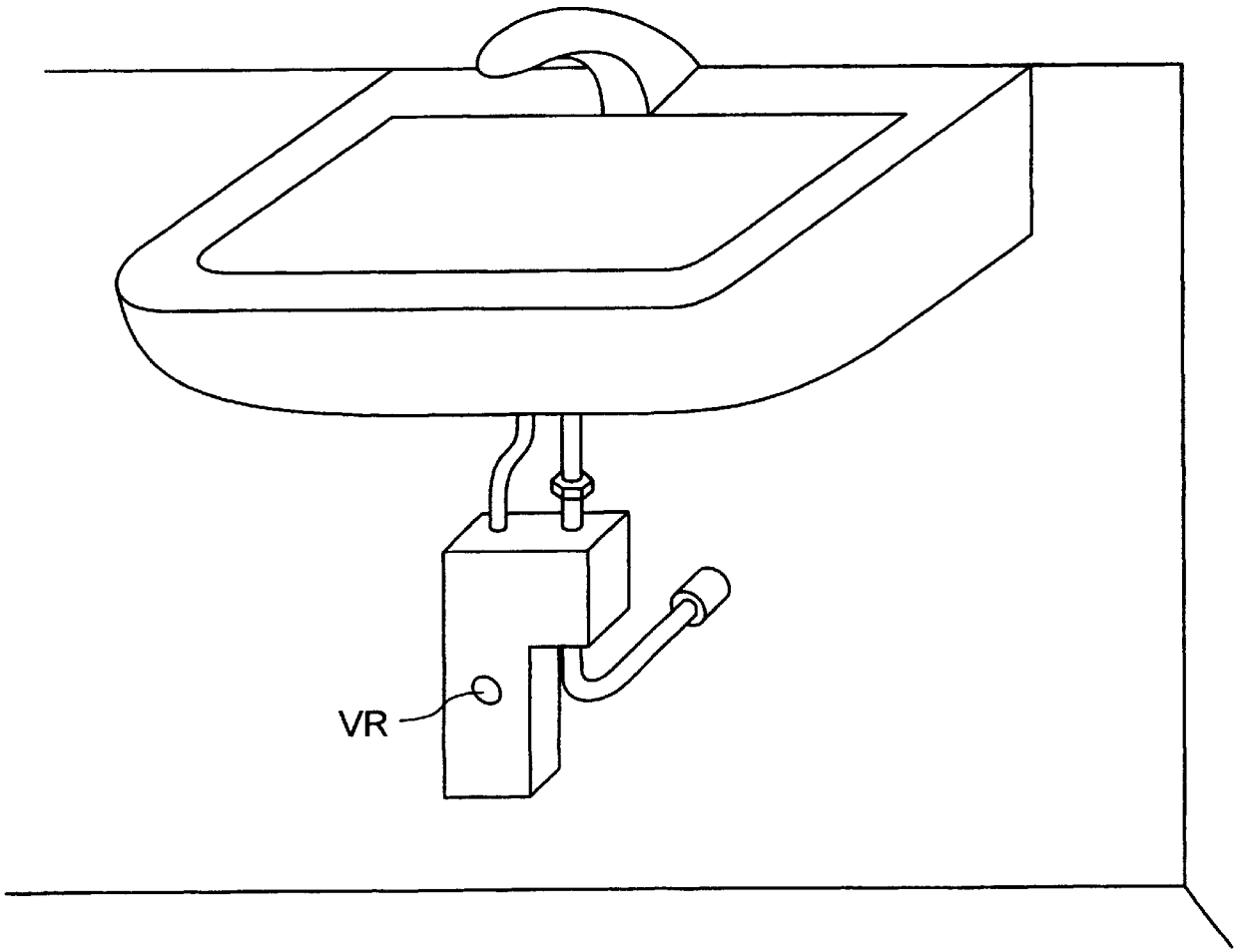
FIG. 8 (PRIOR ART)
FIG. 8 is a diagram explaining the positional relationship between a conventional sink and a reference value correction element.

As shown in FIG. 1, an A/D converter 10 is provided instead of the comparator 7 of FIG. 7. The A/D converter 10 converts a detection output from an amplifier 6 to a four-bit output, which is supplied to a microcomputer 1. The microcomputer 1 performs the same operations as a known automatic faucet, as well as a reference value correction operation which is particular to the present invention. The other elements are known elements, but since the conventional technology of FIG. 7 was not explained in detail, they will be described below.

The microcomputer 1 is battery-operated, and for this reason a microcomputer having low current drain and low operating voltage is used. A battery is used as the power source in view of the fact that commercial power cannot easily be obtained for public toilets and the like, and also because of safety concerns in places where water is used. Therefore, a circuit is designed which will save power as much as possible.

The microcomputer 1 controls the timing of the light-generation by an infrared light transmitter 3, controls the supply of power to all elements, detects power voltage and generates a battery replacement symbol, receives signals from the A/D converter 10, drives the electromagnetic valve 9 using a driver 8, switches the pulse width of the pulse for driving the electromagnetic valve 9 in accordance with changes in the battery voltage, carries out resetting to prevent malfunctions after switching power, indicates an irregularity when infrared rays are detected over a long period, and, in the case of a toilet, saves water when the toilet is used repeatedly, and performs other such control operations.

The drive circuit 2 illuminates the infrared light transmitter 3 in compliance with the output from the microcomputer 1. Infrared rays from the infrared light transmitter 3 are reflected by a part of the user's body, for instance his hands, and reach the infrared light receiver 5. The light transmitter 3 and the light receiver 5 have at least one lens provided on the front surfaces of their elements, to improve their radiating and light-receiving efficiency.

The infrared light receiver 5 combines the characteristics of a photodiode with high operating speed, and a phototransistor capable of producing a large output. The detection signal of the infrared light receiver 5 passes through an amplifier 6 to the A/D converter 10. The A/D converter 10 may be replaced by multiple voltage comparators. Since the signal level of the infrared light receiver 5 fluctuates widely, a log amplifier or the like can be used instead of an amplifier 6, in order to obtain a signal of the appropriate size while preventing saturation.

Figure 2:
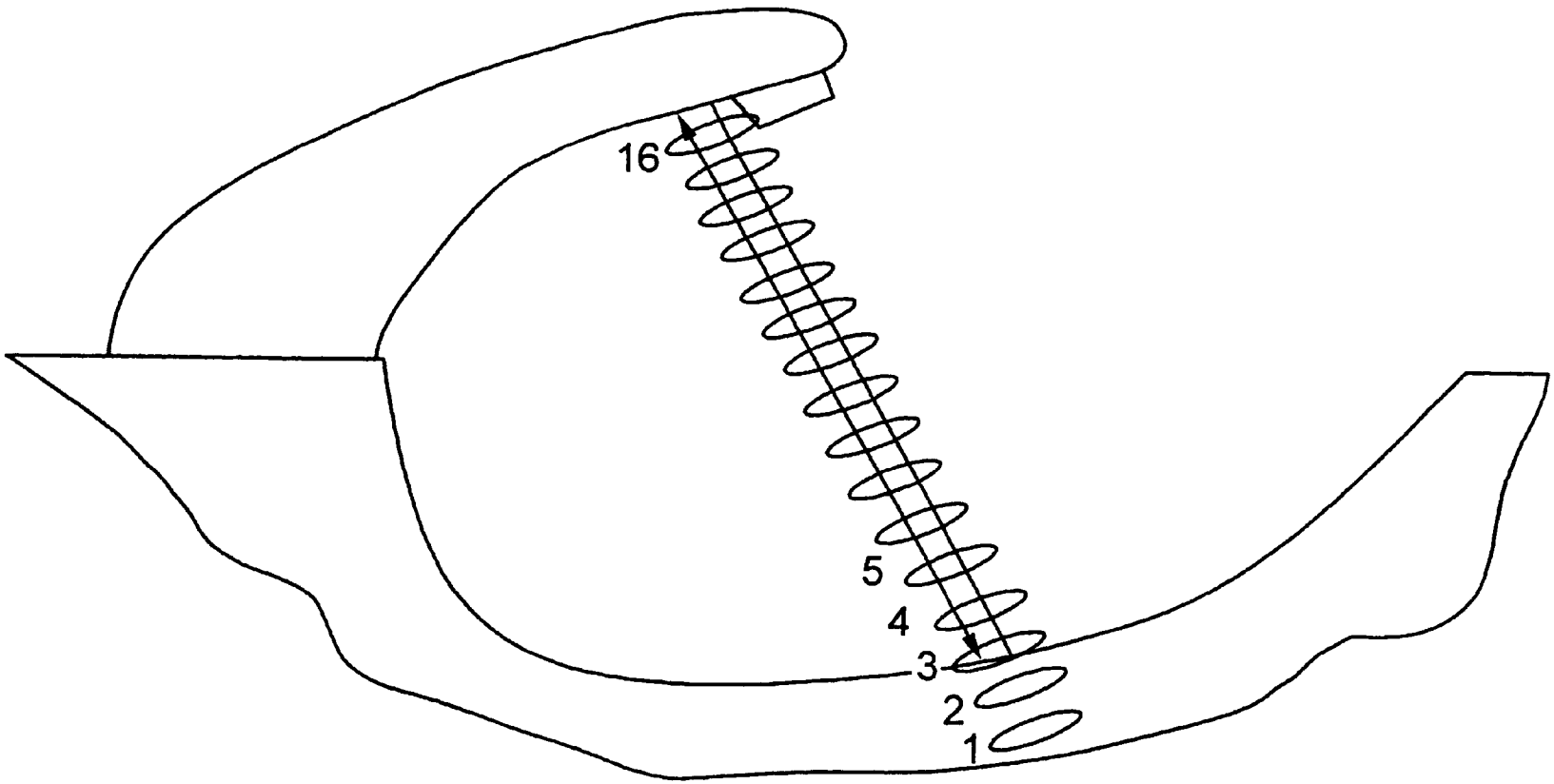
FIG. 2 is a diagram explaining a method of setting the reference value for the flushing operation in the present invention.
Figure 3:
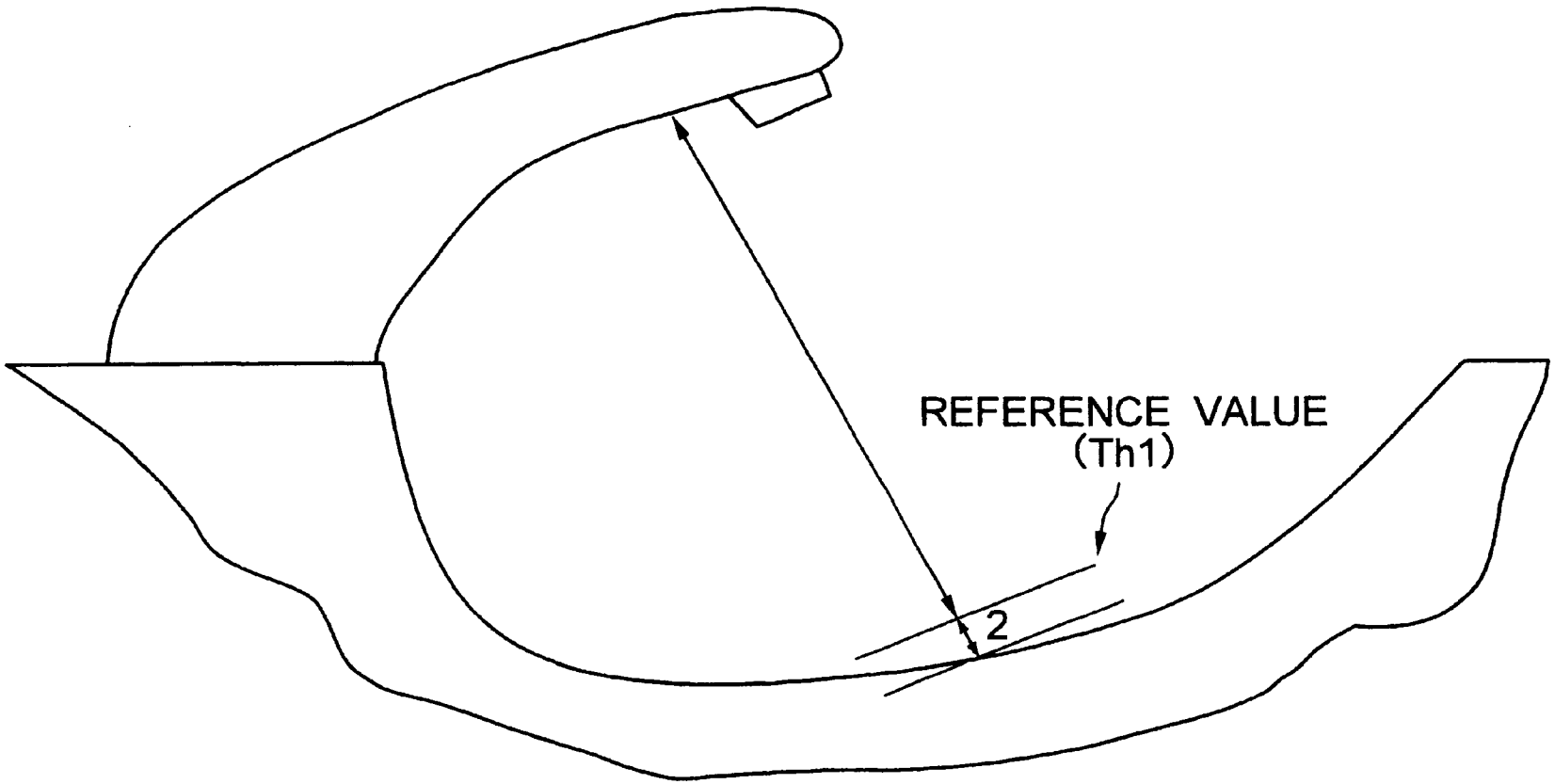
FIG. 3 is a diagram explaining the basic method for setting the reference value in the present invention.
Figure 4:
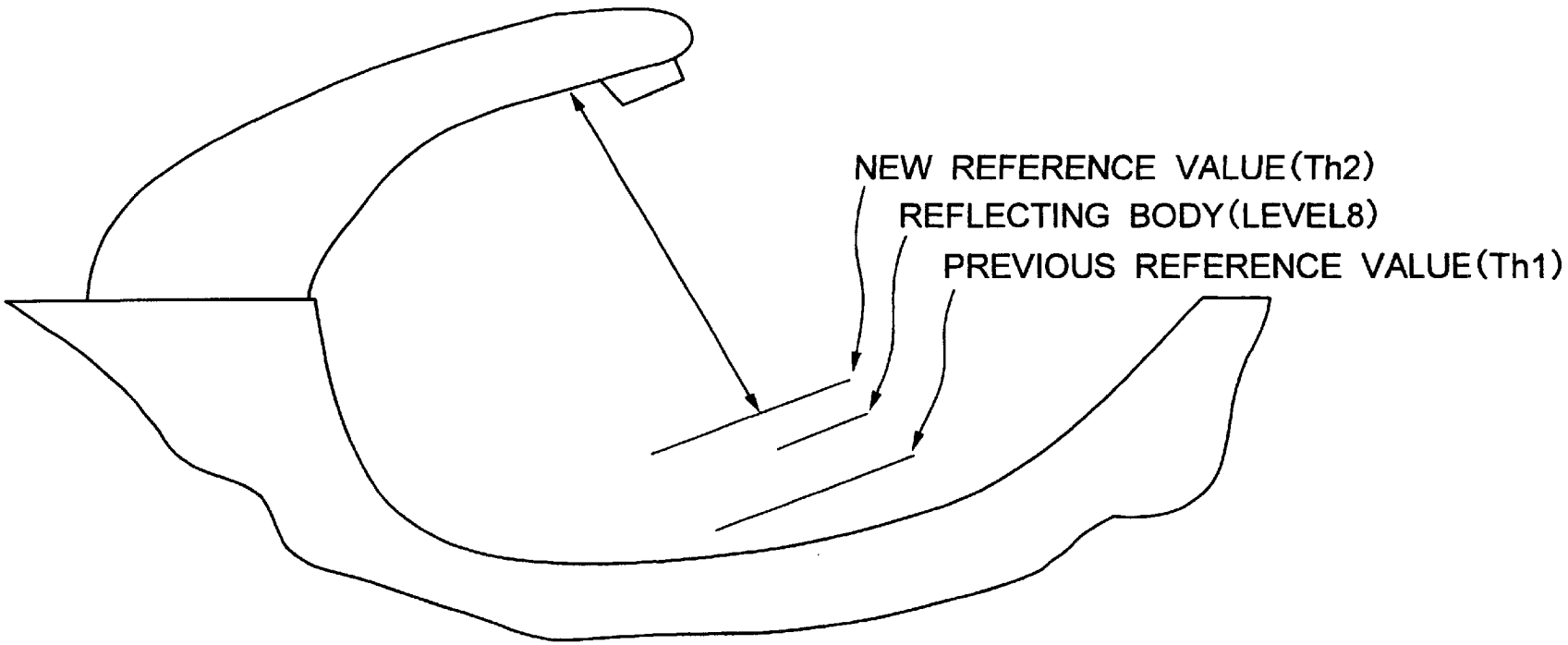
FIG. 4 is a diagram explaining the operation for correcting the reference value in the present invention.

FIG. 2 to FIG. 4 are diagrams indicating the positional relationship between the sink and the tap, and the method of setting a reference value in regard to these. FIG. 2 shows how the reference value is obtained, FIG. 3 shows an example of how the reference value is corrected, and FIG. 4 shows another example of how the reference value is corrected.

Firstly, as shown in FIG. 2, the reference value level is divided into sixteen stages in accordance with the distance between the tap and the bottom of the sink. This is because the A/D converter 10 has a four-bit output. Light which is reflected from the bottom of the sink has a maximum of sixteen levels, and a minimum of one level. That is, the sixteen levels are set such that, when a user's hand is close enough to touch the faucet, the maximum level of reflected light is "16", the maximum level of light reflected from the bottom of the sink is "3", and when the user's hand is at a position slightly further than the bottom of the sink, the maximum level of reflected light is "1". One of these sixteen levels is selected as the reference value in accordance with the condition of the sink.

That is, as shown in FIG. 3, when the maximum level of reflected light at the bottom of the sink is "3", the reference value is set to "5" by adding a tolerance of "2", in order to be able to detect at positions which are closer to the faucet than the bottom of the sink. This gives a detection range from a position slightly above the bottom of the sink to a position at the faucet.

Furthermore, as shown in FIG. 4, when a reflecting body is present in the sink, the reference value is set higher than this. For instance, if the position of the reflecting body is at level "8", a tolerance of "1" is added to set a new reference value of "9".

Figure 5:
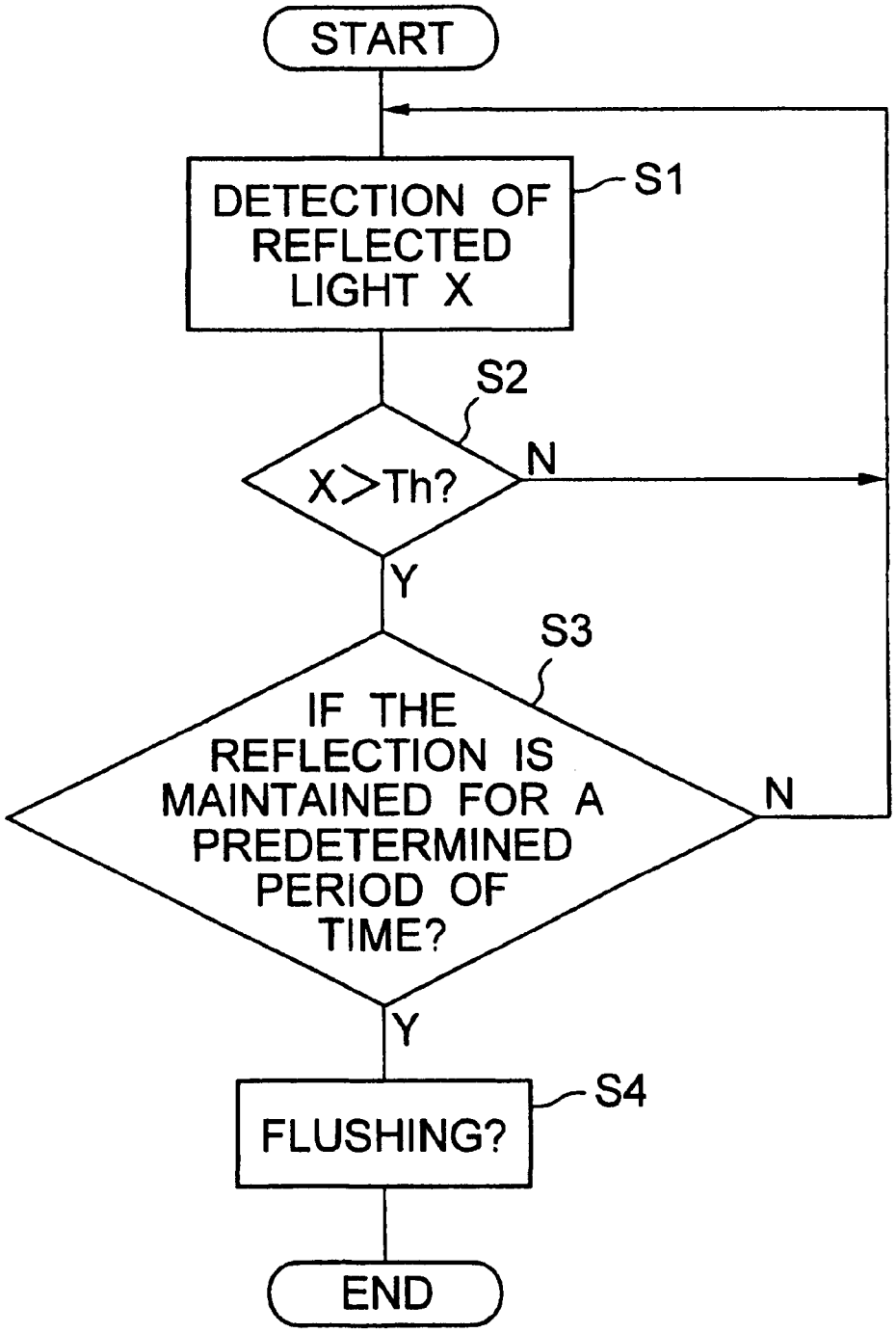
FIG. 5 is a flowchart showing the flushing operation for an automatic faucet.

FIG. 5 is a flowchart showing the flushing operation of an automatic faucet. As shown in Step S1, the automatic faucet constantly monitors the sink surface by radiating infrared rays toward it. Then, when reflected light X, reflected by a hand being inserted or the like, is detected, it is determined whether the reflected light level X exceeds the reference value Th (Step S2). When it does not exceed the reference value Th, the operation returns to detecting reflected light (Step S1).

When the reflected light level X exceeds the reference value Th, it is determined whether the reflection is maintained for a predetermined period of time (Step S3). When this is confirmed, the operation proceeds to Step S4. If the reflection is not maintained for a predetermined length of time the faucet returns to the monitoring mode (Step S1).

Figure 6:
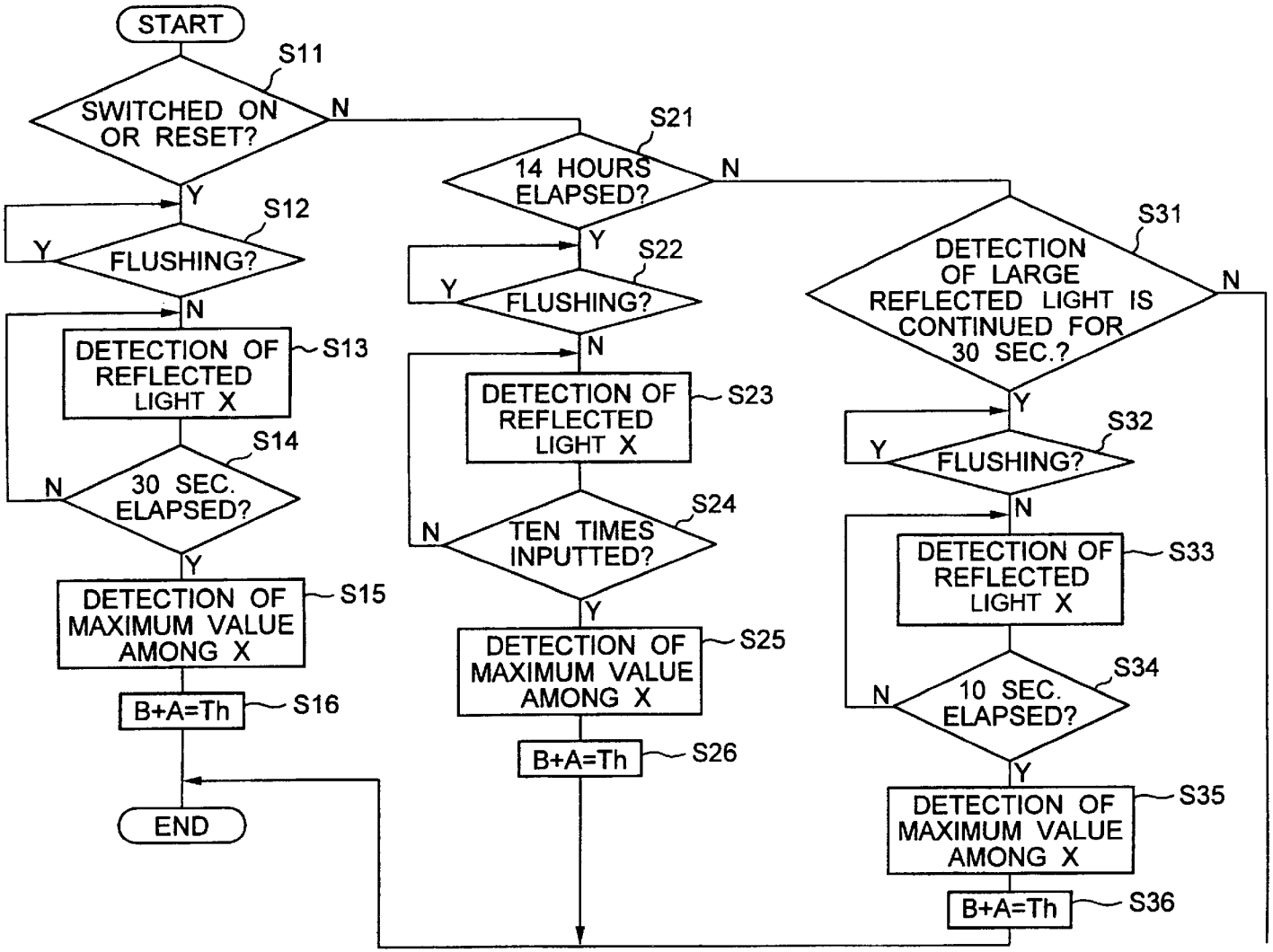
FIG. 6 is a flowchart showing the basic operation for correcting the reference value in the present invention.

FIG. 6 is a flowchart showing a method for setting and resetting the reference value Th used in the Step S2 in FIG. 5. The reference value is set on four occasions: when the power is switched on, when the faucet is reset, when a predetermined period of time has elapsed, and when reflection is detected to have exceeded a predetermined period of time. The reference value is set when switching on the power in accordance with the sink or the state of the power supply, such as when installing the automatic faucet, when switching on the power following a power failure, and the like. The reference value is reset after a maintenance inspection. The reference value is set after a predetermined time has elapsed, for instance when the reference value is corrected every fourteen hours in accordance with changes in the state of the sink and power or the like, the reference value being corrected by a time signal supplied from a timer. To accommodate the various states which occur in one day, a time cycle which allows so reliable shifting to the next 14-hour timing period. Therefore, a shorter or longer time cycle than this is also acceptable.

Finally, the reference value is set when it is detected that reflection has exceeded a predetermined period of time, such as in a case where, for instance, a plate or the like has been placed in the sink, and reflected light exceeding a predetermined amount has been continuously reflected for 30 seconds. In this case, the water is first stopped, and the reference value is corrected if the plate is not removed in the following 10 seconds.

The operation is the same when the power is switched on and when the faucet is reset, but the operation performed after a predetermined time lapse differs in that the reflected light detection time is set slightly longer. Furthermore, in the setting operation performed when reflection has exceeded a predetermined period of time, the reflected light detection time is set slightly shorter. Since the basic operation is roughly identical in each of the four cases, they will be explained together.

Firstly, in Step S11, it is determined whether the setting is to be carried out due to power injection or resetting. When the present case corresponds to neither, the operation ends, but if it corresponds to one of these, the operation shifts to Step S12. In Step S12, it is determined whether flushing is presently being carried out, and when this is confirmed, the sequence waits for the flushing to end before proceeding to Step S13. In Step S13, the size X of reflected light is detected, and the reflected light is detected for a predetermined time, namely 30 seconds, by a feedback operation of a Step S14.

The reflected light can be detected by, for instance, measuring the size of the reflected light when infrared rays are radiated at intervals of 200 milliseconds, and a maximum value B is obtained during Step S15. Then, shifting to Step S16, a predetermined tolerance A is added to the maximum value B to set or reset the reference value Th.

Steps S21 to S26 show the reference correction operations, which is performed every 14 hours. In Step S21, which corresponds to the Step S11, it is determined whether 14 hours have elapsed, and if so, the correction operation commences. In Step S24, which corresponds to Step S14, it is determined whether there have been ten inputs, and reflected light is detected ten times.

Steps S31 to S36 show the reference value correction operation when reflected light has been detected continuously for 30 seconds. In Step S31, which corresponds to the Step S11, it is determined whether reflected light exceeding the reference value has been detected continuously for 30 seconds, and if so, the correction operation commences. Then, in Step S34, which corresponds to Step S14, it is determined whether 10 seconds have elapsed, and reflected light is detected for 10 seconds.

The flush operation, explained using FIG. 5, is carried out based on reference values set in this way. Since the reference value is corrected regularly in a cycle of less than one day, the reference value is automatically corrected after the cycle has elapsed, even when the sink gradually becomes dirty, or when it has suddenly been cleaned. In addition, the reference value can be corrected at any time by manually resetting it, or by turning the power off and on again.

As described above, according to the present invention, the reference value is corrected based on the amount of light reflected when a command signal is applied. Therefore, even when there is a change in the state of the power, the sink or the like can be flushed automatically as required, eliminating complex operations for adjusting the reference value.

What is claimed is:

1. An automatic faucet, comprising a faucet; a light generator for radiating infrared rays toward the bottom of a sink; a light receiver for receiving infrared rays reflected from the bottom of said sink, and detecting an amount of light thereby received; a flush output portion for comparing the detection output from said light receiver with a reference value, and creating a flush output when the detection output exceeds a predetermined value; and a faucet controller for opening and closing said faucet in accordance with an output of said flush output portion;

the automatic faucet further comprising:

a command device for generating a command signal to correct the reference value;

a detection device for detecting a maximum amount of light, received by said light receiver, when a signal has been supplied by said command device;

a reference value correction device for correcting the reference value in said flush output portion, based on the maximum amount of light detected and a predetermined tolerance added thereto; and a timer for providing an output to said command device when a predetermined time has passed, the predetermined time being more than twelve hours and less than one day.

2. The automatic faucet according to claim 1, wherein said command device generates the command signal when a reset operation is performed.

3. The automatic faucet according to claim 1, wherein said command device generates the command signal each time a predetermined period of time has elapsed.

4. The automatic faucet according to claim 1, wherein the reference value correction device performs correction by selecting one of a plurality of predetermined correction levels.

5. The automatic faucet of claim 1, wherein said reference value correction device corrects the reference value in the event of a reflected light exceeding a predetermined amount for a predetermined length of time, and then said faucet controller closes said faucet in the event that a reflected light exceeds a predetermined amount for a predetermined length of time, and after a time shorter than the predetermined length of time said reference value correction device corrects the reference value.

6. The automatic faucet of claim 1, wherein said detection device detects a maximum value among a predetermined number of inputs.

* * * * *